United States Patent [19]

Markus

[11] Patent Number: 4,641,462

[45] Date of Patent: Feb. 10, 1987

[54] DEVICE FOR OPENING AND CLOSING A SLIDING-DOOR

[76] Inventor: Jan J. G. Markus, Griendstraat 11, Krimpen aan den Ijssel, Netherlands

[21] Appl. No.: 721,967

[22] Filed: Apr. 11, 1985

[30] Foreign Application Priority Data

Apr. 26, 1984 [NL] Netherlands ..... 8401339

[51] Int. Cl.[4] ..... E05B 1/00; E05B 7/00

[52] U.S. Cl. ..... 49/460; 16/110 R; 16/DIG. 24

[58] Field of Search ..... 49/460; 16/110 R, 112, 16/123, DIG. 24; 74/543, 545, 209, 210, 372

[56] References Cited

U.S. PATENT DOCUMENTS 1,589,496 6/1926 Whalbe ..... 16/110 R
3,188,711 6/1965 Koppen ..... 16/123

FOREIGN PATENT DOCUMENTS 29319 2/1958 Finland ..... 16/110 R
257847 9/1926 United Kingdom ..... 16/110 R

*Primary Examiner*—James T. McCall
*Assistant Examiner*—Gerald A. Anderson
*Attorney, Agent, or Firm*—Sughrue, Mion, Zinn, Macpeak, and Seas

[57] ABSTRACT

A device for opening and closing a sliding-door, of the type wherein the rollers by which the door is carried sink into recesses in the guide-rail when the door is in front of the doorway so that the door, when opening it, has to be lifted somewhat, said device comprising a lever rotatable around a rotation shaft, the one arm of which is provided with a push-off cam and the other arm of which forms an operating handle, said lever being supported in the door in such a manner that, when the door has almost reached a final position, the lever can assume a position which is inclined in respect of a vertical line, by which the operating handle will be at a larger distance from the immediately adjacent post of the door-frame than the rotation shaft of the lever.

11 Claims, 4 Drawing Figures

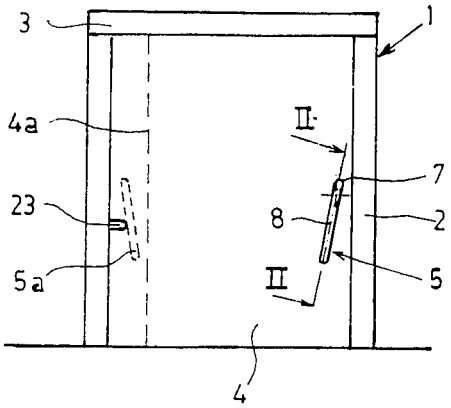
FIG. 1
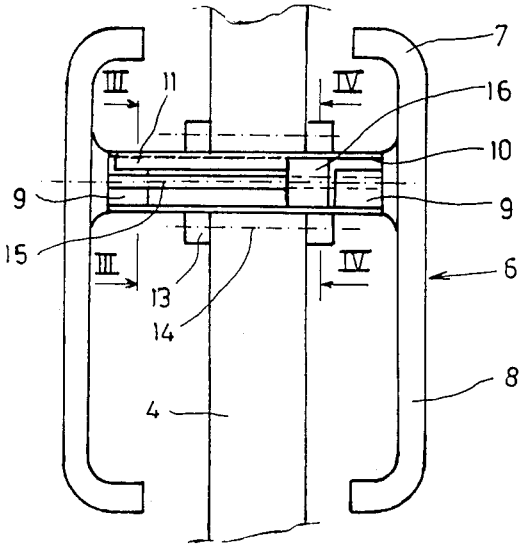
FIG. 2
FIG. 3
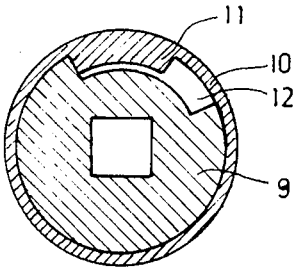
FIG. 4
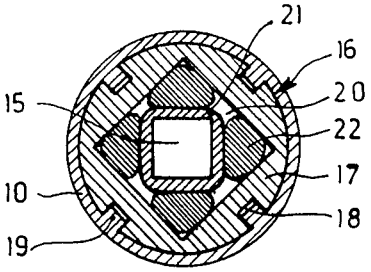

DEVICE FOR OPENING AND CLOSING A SLIDING-DOOR

FIELD OF THE INVENTION

The invention relates to a device for opening and closing a sliding-door, in particular for a sliding-door of the type wherein the rollers by which the door is carried sink into recesses in the guide-rail when the door is in front of the doorway so that the door is moved towards the wall and when opening it has to be lifted to bring the rollers on the carrying surface of the guide-rail, said device comprising at least one lever rotatable around a rotation shaft, the one arm of which is provided with a push-off cam and the other arm is forming an operating handle.

BACKGROUND OF THE INVENTION

A device of the above indicated type is known from the German Pat. No. 2,758,521.

In this device the rotatable lever always assumes a vertical position after having been used. A disadvantage thereof is that the operating handle will be close to the post of the door-frame in the final position of the door. This applies in particular for the operating handle which is present at that side of the sliding-door which is facing the door opening.

It has appeared that the small distance present between the operating handle and the door-frame may cause problems when opening and closing the door. This applies in particular for persons with a physical handicap.

SUMMARY OF THE INVENTION

It is, accordingly, an object of the invention, to avoid these problems and provides to this purpose, that the rotation shaft of the lever is supported in the door in such a manner, that when the door has almost reached a final position, the lever can assume a position which is inclined in respect of a vertical line, by which the operating handle will be at a larger distance from the immediately adjacent post of the door-frame than the rotation shaft of the lever when the door has almost reached a final position.

This implies for example that in the closed final position of the sliding-door the lower end of the lever, forming the operating handle, is directed somewhat towards the middle of the door, whereas in the completely opened final position of the door the lower end of the lever just will be present at the other side of the vertical line running through the rotation shaft of the lever.

According to an elaboration of the invention this is achieved in that a cylindrical sleeve has been fixed in the door, in which sleeve a part connected with the lever has been rotatably mounted, means being provided to limit the angle of rotation of the lever with respect to the sleeve so that the lever may assume two extreme positions, an annular element being mounted in the cylindrical sleeve comprising an outer and an inner casing which are not rotatable with respect to the sleeve and the levers respectively, flexible elements being mounted between these casing in such a manner that the lever is biassed to that position which it assumes when the door is closed.

In this manner it is achieved that almost the complete system serving for bringing the lever in a particular final position, is present within the door.

For bringing the lever in another position an abutment can be provided on that post of the door-frame towards which the lever moves when opening the door, by which abutment the lever will be brought to the other position than the position to which it is biased.

According to an embodiment of the invention the cylindrical sleeve comprises a radially inwardly extending cam, running over a specific angle, the part connected with the lever being provided with a recess extending over a larger angle in which recess the cam may be inserted.

The outer casing of the annular element may be held nonrotatably with respect to the sleeve by means of grooves and tongues and the inner casing internally may have a square cross-section so that the square shaped shaft, connected with the lever, can be mounted in this.

According to an embodiment of the invention the exterior of the inner casing and the interior of the outer casing of the annular element may both be square but having such different dimensions that rods of a resilient material such as rubber can be provided in the corners of the outer casing, said rods lying against the edges of said inner casing.

In this manner it is achieved that the operating lever can never remain in the vertical position, but will always be biassed towards the one final position, said position being limited by the co-operation of the cam in the cylindrical sleeve and the recess in the part connected with the lever.

BRIEF DESCRIPTION OF THE DRAWING

For a better understanding of the invention, as well as the above and other objects and nature and advantages of the instant invention, a possible embodiment thereof will now be described with reference to the attached drawings, it being understood that this embodiment is to be intended as merely exemplary and in no way limitative.

FIG. 1 shows a front view of a door-frame with a sliding-door lying against it, provided with an operating device according to the present invention;

FIG. 2 shows a cross-section of the operating device along the line II—II of FIG. 1; and FIGS. 3 and 4 show cross-sections according to the lines III—III and IV—IV respectively of FIG. 2.

DETAILED DESCRIPTION OF THE PREFERRED EMBODIMENT

FIG. 1 shows a door-frame 1, consisting of the vertical posts 2 and the upper beam 3, said frame 1 being positioned in a wall, not shown. A sliding-door 4 is lying against the rear of the door-frame as shown, said sliding-door 4 being provided with the operating device 5.

As appears in particular from the FIGS. 2–4, the operating device 5 comprises the levers 6, the upper part 7 of each of which forms the push-off cam and the lower part 8 the operating handle.

Each lever 6 comprises a substantially cylindrical part 9, rotatable in the cylindrical sleeve 10 which is provided with a radially inwardly extending cam 11 co-operating with a recess 12 in the cylindrical part 9. Thus, this part can make only a limited rotation with respect to the cylindrical sleeve 10 which is fixed onto the door 4 by means of bolts 14 and rings 13 fixed onto the sleeve 10.

Both levers 6 are interconnected by means of a square rotation shaft or rod 15, which has been inserted into corresponding recesses in the cylindrical parts 9 and is fixed therein for example by means of set screws, not shown.

The levers 6 are fully identical, thus making their manufacture cheaper. The cam 11 in the cylindrical sleeve 10 does not extend over the full length of the sleeve, but ends at the annular element 16, the construction of which is particularly shown in FIG. 4. As appears from this figure the annular element comprises an outer and an inner casing. The outer casing 17 is provided with some grooves 18 into which tongues 19 of the sleeve 10 can be inserted, the outer casing 17 thus not being rotatable with respect to the sleeve 10 and with respect to the door 4. The outer casing 17, in addition, is provided with a rectangular recess 20, within which is located the inner casing 21 having a square bore, thus allowing the square rod 15, connecting the levers 6, to pass through the bore. Between the outer casing 17 and the inner casing 21 four rubber rods 22 are positioned biassing the inner casing 21 and thus the rod 15 to a specific position with respect to the outer casing 17 and thus with respect to the door 4.

The outer casing 17 and the inner casing 21 are kept in position in axial direction with respect to each other by means of end-plates, not shown, which for example are clamped onto the inner casing 21.

At the right hand side of FIG. 1 the operating device 5 is shown in a position in which the cam 11 of the sleeve 10 is lying against one of the end-walls of the recess 12 in the cylindrical part 9 of the lever 6, in which position it is resiliently held by means of the annular element 16. The operating handle 8 can now be gripped easily for opening the sliding-door, as it is at a sufficient distance from the post 2 of the door-frame. When now the door 4 is moved to the left the handle 8 will come to lie against an abutment 23, which will cause the lever 6 to be pushed towards the position 5*a*, as shown at the left hand side of FIG. 1. The door then is in the opened position and the right hand edge of the door is indicated by means of the dash line 4*a*. In this position 5*a* the right hand face of the cam 11, as seen in FIG. 3 may be in contact with the adjacent face of the recess 12 in the cylindrical part 9 of the lever 6.

When moving the sliding-door again towards the closed position, the operating handle will get free from the abutment 23 and the lever 6 again will assume the position shown at the right hand side of FIG. 1.

It will be obvious to those skilled in the art that various changes may be made without departing from the scope of the invention and the invention is not to be considered limited to what is shown in the drawings and described in the specification.

What is claimed is:

1. A device for opening and closing a sliding-door slidable between a final open position and a final closed position in a door-frame having two horizontally spaced-apart vertical posts, in particular for a sliding-door of the type wherein rollers by which the door is carried sink into recesses in a guide-rail when the door is in front of a doorway in a wall so that the door is moved towards the wall, and, when opening, the door has to be lifted to bring the rollers onto a carrying surface of the guide-rail, said device comprising: at least one lever rotatable with a rotation shaft and having two arms, one arm of which is provided with a push-off cam and the other arm of which forms an operating handle, the rotation shaft of the lever being supported in the door in such a manner that, when the door has almost reached either of said final open or said final closed positions, the lever can assume a position which is inclined in respect of a vertical line, so that the operating handle will be at a larger distance from an immediately adjacent one of the posts of the door-frame than the rotation shaft of the lever when the door has almost reached a final position; a cylindrical sleeve fixed in the door, in which sleeve a part connected with the lever is rotatably mounted; means for limiting the angle of rotation of the lever with respect to the sleeve so that the lever may assume two extreme lever positions; and annular element mounted in the cylindrical sleeve and comprising an outer and an inner casing which are not rotatable with respect to the sleeve and the levers, respectively; and flexible elements mounted between these casings in such a manner that the lever is biased to that lever position which the lever assumes when the door is closed.

2. A device according to claim 1, in which an abutment is provided on that post of the door-frame towards which the lever moves when opening the door, by which abutment the lever is moved to the lever position other than that to which it is biased.

3. A device according to claim 1, in which said cylindrical sleeve comprises a radially inwardly extending cam, running over a specific angle, the part connected with the lever being provided with a recess extending over a larger angle in which recess the cam is inserted.

4. A device according to claim 1, in which the shaft has a square-shaped cross-section, and in which the outer casing of the annular element is held non-rotatably with respect to the sleeve by means of grooves and tongues and the inner casing internally has a square cross-section bore which receives the square shaped shaft connected with the lever.

5. A device according to claim 1, in which said flexible elements are rods of resilient material, and in which the exterior of the inner casing and the interior of the outer casing of the annular element are both square but have such different dimensions that said rods of a resilient material are disposed in the corners of the square of the outer casing and lie against the edges of the square of said inner casing.

6. A device for opening and closing a sliding door slidable between a final open position and a final closed position in a door-frame having two horizontally spaced-apart vertical posts, said device comprising at least one lever rotatable with a square-shaped rotation shaft and having two arms, the one arm of which is provided with a push-off cam and the other of which forms an operating handle, the rotation shaft of the lever being supported in the door in such a manner that, when the door has almost reached one of said final positions, the lever can assume a position which is inclined in respect of a vertical line so that the operating handle will be at a larger distance from the immediately adjacent post of the door-frame than the rotation shaft of the lever when the door has almost reached a final position, a cylindrical sleeve fixed in the door, in which sleeve a part connected wtih the lever is rotatably mounted, an annular element mounted in the cylindrical sleeve and comprising an outer and an inner casing, said outer casing being held non-rotatably with respect to the sleeve by means of grooves and tongues and said inner casing internally having a square cross-section bore receiving the square shaped shaft connected with the lever, the exterior of the inner casing and the interior of the outer casing of the annular element both being square but having such different dimensions that spacing is provided between the casings for rods of a resilient material to be disposed in the corners of the outer casing and to lie against the edges of the square of said inner casing for biasing said inner casing to a given position, said cylindrical sleeve comprising a radially inwardly extending cam running over a specific angle, the part connected with the lever being provided with a recess extending over a larger angle in which recess the cam is inserted, so that the lever may assume two extreme positions.

7. A device for opening and closing a sliding-door slidable between a final open position and a final closed position in a door-frame having two horizontally spaced-apart vertical posts, said device comrpsing: at least one lever rotatable with a rotation shaft and having two arms, one arm of which is provided with a push-off cam and the other arm of which forms an operating handle, the rotation shaft of the lever being supported in the door in such a manner that, when the door has almost reached either of said final open or said final closed positions, the lever can assume a position which is inclined in respect of a vertical line, so that the operating handle will be at a larger distance from an immediately ajdacent one of the posts of the door-frame than the rotation shaft of the lever when the door has almost reached one of said final positions a cylindrical sleeve fixed in the door, in which sleeve a part connected with the lever is rotatably mounted; means for limting the angle of rotation of the lever with respect to the sleeve so that the lever may assume two extreme lever positions; and annular element mounted in the cylindrical sleeve and comprising an outer and an inner casing which are not rotatable with respect to the sleeve and the levers, respectively; and flexible elements mounted between these casings in such a manner that the lever is biased to that lever position which the lever assumes when the door is closed.

8. A device according to claim 7, in which an abutment is provided on that post of the door-frame towards which the lever moves when opening the door, by which abutment the lever is moved to the lever position other than that to which it is biased.

9. A device according to claim 7, in which said cylindrical sleeve comprises a radially inwardly extending cam, running over a specific angle, the part connected with the lever being provided with a recess extending over a larger angle in which recess the cam is inserted.

10. A device according to claim 7, in which the shaft has a square-shaped cross-secttion, and in which the outer casing of the annular element is held non-rotatably with respect to the sleeve by means of grooves and tongues and the inner casing internally has a square cross-section bore which receives the square shaped shaft connected with the lever.

11. A device according to claim 7, in which said flexible elements are rods of resilient material, and in which the exterior of the inner casing and the interior of the outer casing of the annular element are both square but have such different dimensions that said rods of a resilient material are disposed in the corners of the square of the outer casing and lie against the edges of the square of said inner casing.

* * * * *